US006135311A

United States Patent [19]

Panec et al.

[11] Patent Number: 6,135,311

[45] Date of Patent: Oct. 24, 2000

[54] DRINK VALVE

[75] Inventors: Donald J. Panec, Redwood City; Scott H. Stillinger, Monte Sereno, both of Calif.

[73] Assignee: Acorn Bay, LLC, S. San Francisco, Calif.

[21] Appl. No.: 09/159,310

[22] Filed: Sep. 23, 1998

[51] Int. Cl.[7] ..... A47G 19/00

[52] U.S. Cl. ..... 220/705; 222/402.21; 222/402.22

[58] Field of Search ..... 220/705, 703, 220/715, 714; 222/505, 509, 531, 527, 402.21, 402.22

[56] References Cited

U.S. PATENT DOCUMENTS

| | | | |
|---|---|---|---|
| 274,447 | 3/1883 | Kennish . | |
| 1,550,305 | 8/1925 | Dreischerf . | |
| 2,691,466 | 10/1954 | Efford et al. . | |
| 2,773,722 | 12/1956 | Abplanalp . | |
| 2,781,956 | 2/1957 | Sherbondy . | |
| 2,802,608 | 8/1957 | Gassaway . | |
| 2,948,453 | 8/1960 | Drown . | |
| 3,042,319 | 7/1962 | Burd . | |
| 3,067,787 | 12/1962 | Salk . | |
| 3,165,241 | 1/1965 | Curry . | |
| 3,285,477 | 11/1966 | Marona et al. . | |
| 3,620,421 | 11/1971 | MacGuire-Cooper | 222/402.21 |
| 3,819,151 | 6/1974 | Kish . | |
| 4,159,790 | 7/1979 | Bailey . | |
| 4,165,825 | 8/1979 | Hansen | 222/402.22 |
| 4,179,052 | 12/1979 | Abbott | 222/509 |
| 4,245,752 | 1/1981 | Prueher . | |
| 4,450,985 | 5/1984 | Beard . | |
| 4,483,465 | 11/1984 | Lawrence . | |
| 4,776,495 | 10/1988 | Vignot . | |
| 4,828,141 | 5/1989 | Coy | 220/714 X |
| 4,927,061 | 5/1990 | Leigh et al. . | |
| 4,941,598 | 7/1990 | Lambelet et al. . | |
| 5,301,858 | 4/1994 | Hollander . | |
| 5,431,308 | 7/1995 | Tchen . | |
| 5,465,866 | 11/1995 | Belcastro | 220/715 X |
| 5,791,510 | 8/1998 | Paczonay | 220/703 |
| 5,850,908 | 12/1998 | Jasek | 220/703 X |

FOREIGN PATENT DOCUMENTS

| | | |
|---|---|---|
| 31 659 | 9/1964 | Germany . |
| 45-37339 | 5/1966 | Japan . |
| 925 408 | 5/1982 | U.S.S.R. . |
| 239/579 | of 1904 | United Kingdom . |

*Primary Examiner*—Steven Pollard
*Attorney, Agent, or Firm*—Kolisch Hartwell Dickinson McCormack & Heuser

[57] ABSTRACT

A drink valve for use with a drink container is disclosed. The valve includes a straw structure with a gate structure or plug at one end. The gate structure opens and closes to regulate the flow of liquid. The gate structure is opened upon movement of the straw structure. The gate structure may include members which spread apart upon movement of the straw structure, and which come together when the straw structure is released.

25 Claims, 10 Drawing Sheets

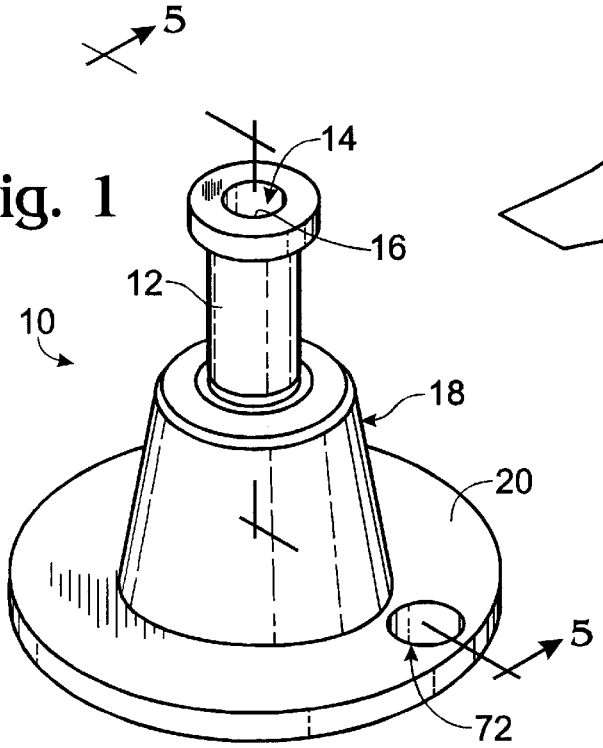
Fig. 1
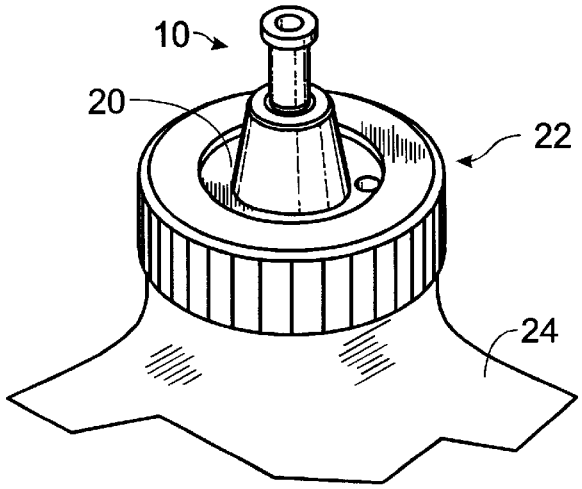
Fig. 2
Fig. 3
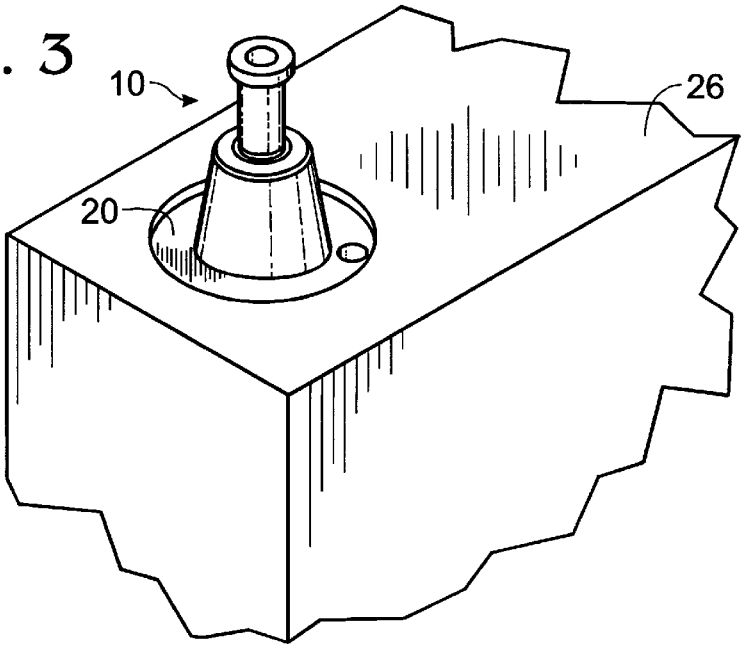

DRINK VALVE

TECHNICAL FIELD

This invention relates to drink valves, and more specifically, to a valve for use on aseptic drink boxes, plastic drink bottles, and other drink containers.

BACKGROUND ART

Water bottles, plastic soda bottles, disposable drink boxes and disposable juice bottles have become popular ways to conveniently package and sell drinks. Some of these containers, such as plastic bottles, include a cap with a spout that opens and closes to let a user take a drink. Disposable drink boxes often include a hole in the top of the box covered by thin layers of foil and plastic, and the boxes are sold with a straw used to pierce the foil and plastic and extend through the hole for drinking. Containers such as these are useful, but have the drawback of allowing liquid to spill. For example, when the spout on a plastic drink bottle is open, liquid will spill if the bottle tips over. Drink boxes will also spill when tipped. Additionally, drink boxes often spill when the straw is inserted because the user is holding the box in one hand while trying to insert the straw through the foil and plastic into the straw hole. The pressure of holding the box and pressing the straw against the foil and plastic often causes the liquid to spray out of the hole or out of the straw as soon as the foil and plastic are pierced. The invention described herein provides a drink valve which prevents drinks from being spilled and which is easy to manufacture and use.

SUMMARY OF THE INVENTION

The invention is a drink valve intended for use with a drink container. The valve includes a straw-like structure with a gate structure or plug at one end. The gate structure or plug opens and closes to regulate the flow of liquid. The gate structure or plug is typically closed, and is opened upon movement of the straw-like structure. For example, a user may open the gate structure by tilting the straw-like structure to one side or by moving it down. When the straw-like structure is released, it returns to its normal position and the gate structure or plug is closed. This valve allows a user easily to open the gate-like structure or plug to take a drink, but prevents liquid from spilling if the drink container is tipped or if the user has not opened the valve by moving the straw-like structure.

BRIEF DESCRIPTION OF THE DRAWINGS

FIG. 1 is a perspective view of an embodiment of the invented drink valve.

FIGS. 2–4 show embodiments of the drink valve with various drink containers.

DETAILED DESCRIPTION AND BEST MODE FOR CARRYING OUT THE INVENTION

Figure 4:
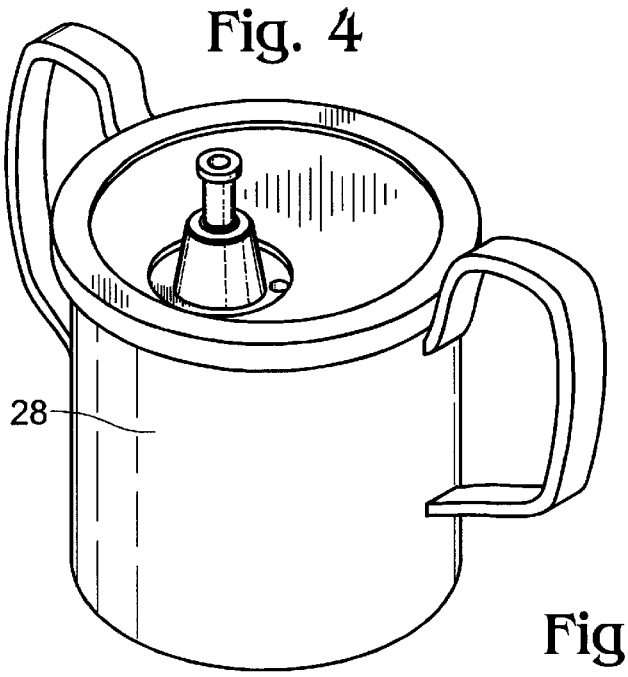

FIG. 1 shows an embodiment of the invented drink valve at 10. The valve includes a straw structure 12, which is tubular so that it includes an internal passageway 14 through which liquid may flow. The straw structure includes an opening or exit port 16 at the top end of the passageway. The valve includes a support 18 joined to the straw structure to support the straw structure while allowing the straw structure to move, as will be described below. A flange 20 extends from the bottom of the support and allows the valve to be mounted in a drink container. The flange may be thought of as part of the support.

FIG. 2 shows the invented valve mounted in a lid 22 of a plastic or glass bottle 24. For example, bottle 24 may be a plastic soda bottle, a plastic water bottle, a glass juice bottle, an athletic bottle, or any one of a number of drink containers. Flange 20 is mounted to lid 22 by any acceptable means, such as by glue or pressure. Bottle 24 acts as an enclosure defining a region for the storage of liquid. The liquid may exit the bottle through valve 10 when a user actuates the valve.

Valve 10 may also be mounted on an aseptic drink box 26, as shown in FIG. 3. Drink boxes are popular for fruit juices, fruit punch, chocolate-flavored drinks and other beverages. Flange 20 is mounted to an aperture in the upper surface of drink box 26, as shown. The flange may be mounted to the drink box in any acceptable manner, such as by an adhesive or heat seal.

Valve 10 may also be mounted in a cup for a child or toddler, such as cup 28 shown in FIG. 4.

The invented valve may be used on any number of drink containers to prevent liquid from being spilled. The valve is especially applicable for the drink containers discussed above, but it is also applicable for other containers, such as cups with lids used for hot drinks like coffee, or cups used for fountain drinks. It is also possible to use the valve with other containers of food substances, such as bottles of sauces, salad dressings, syrups or oils.

Figure 5:
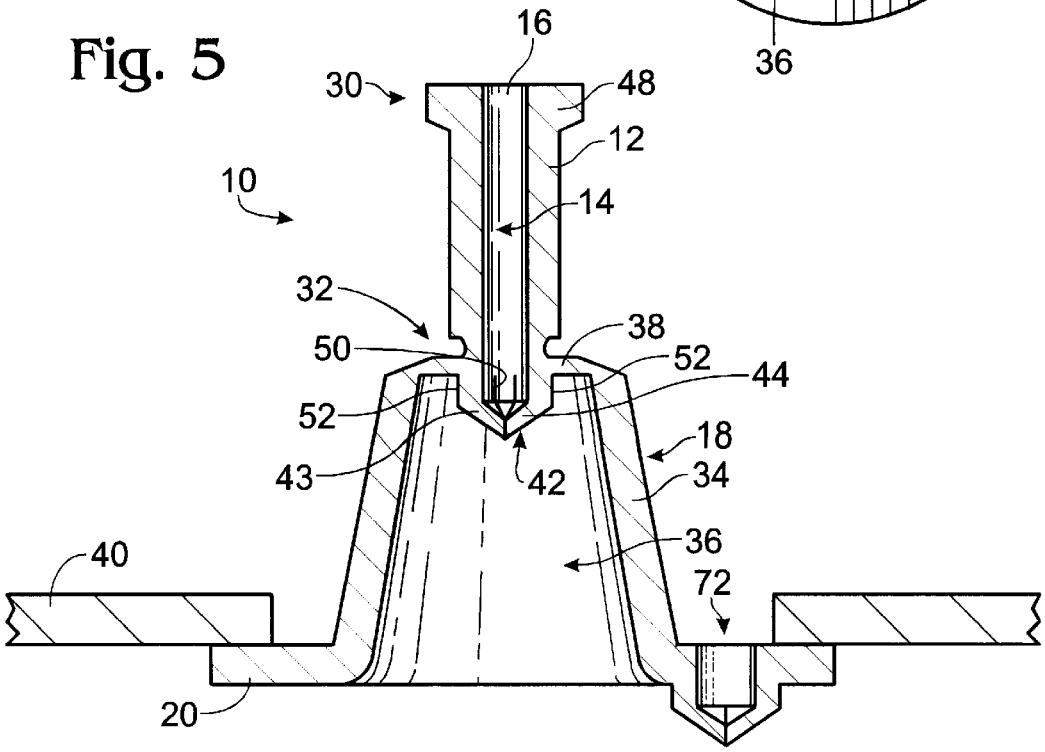
FIG. 5 is a cross-sectional view of the drink valve of FIG. 1.

FIG. 5 shows a cross-section of valve 10, which helps illustrate how the valve functions. FIG. 5 shows straw structure 12 with passageway 14. Straw structure 12 has two ends, a first end 30 and a second end 32. Opening or exit port 16 is in the first end 30 of the straw structure. Passageway 14 extends within the straw structure from opening 16 to the second end of the straw structure. Straw structure 12 and passageway 14 are typically circular in cross-section, but may take different shapes and/or cross-sections.

A support 18 is joined to the straw structure to support the straw structure. Support 18 is typically circular in cross-section, but also may take different shapes and/or cross-sections. The support includes a perimeter wall 34 defining an open region 36. The support further includes a shoulder section 38 which is joined to second end 32 of the straw structure, and which surrounds the straw structure and extends between perimeter wall 34 and second end 32. Flange 20 extends from the base of perimeter wall 34. Flange 20 may be mounted to a drink container by a heat seal, glue or by any other suitable means. In FIG. 5, flange 20 is shown glued to the bottom surface of a portion 40 of a drink container. Often the flange will be heat sealed to the top surface of portion 40.

Figure 7:
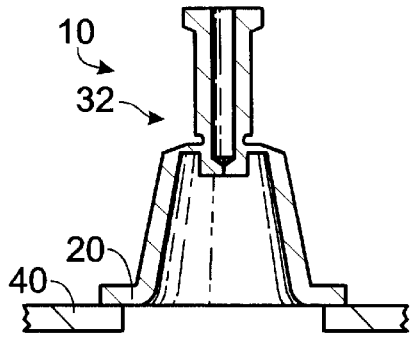
FIG. 7 shows a drink bottom valve with a smaller mounting flange.
Figure 8:
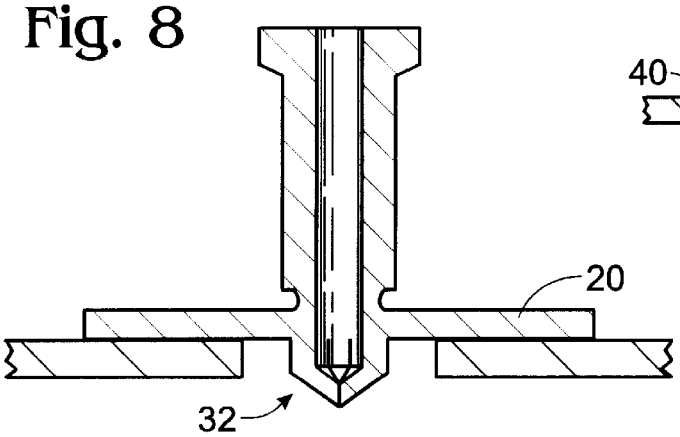
FIG. 8 shows another embodiment of the invention.

Flange 20 may take different forms. FIG. 7 shows an embodiment of the valve with a smaller flange, and the flange is heat sealed to the top of portion 40 of a drink container. In other embodiments, wall 34 and shoulder 38 may be removed so that flange 20 extends outwardly from second end 32 of the straw structure, as shown in FIG. 8. In that case, the flange acts as the support for the straw structure.

Valve 10 also includes a gate structure 42 positioned at the second end 32 of the straw structure. The gate structure may also be called a plug. The gate structure or plug is configured to open and to close passageway 14 to regulate the flow of liquid into the passageway. FIG. 5 shows gate structure 42 closed. Any liquid within the drink container may flow into open region 36, but the liquid may not flow into passageway 14 and out exit port 16 because gate structure 42 blocks or closes the passageway. In use, a user would actuate the valve to open gate structure 42 so that liquid may flow through open region 36 and passageway 14 and out exit port 16.

In some embodiments of the invention, gate structure 42 is made from a plurality of members or segments which come together to close passageway 14 and which spread out and apart to open the passageway. Two of these members are shown at 43 and 44 in FIG. 5. The members are angled down and join together in a point, as shown in FIG. 5. In this manner, when pressure within a drink container increases and pushes against the gate structure, the angling of the members helps prevent the gate structure from opening, and the pressure within the drink container pushes the members together to further close the gate structure. Alternatively, the members could extend perpendicularly across the passageway, as shown in FIG. 7.

Figure 6:
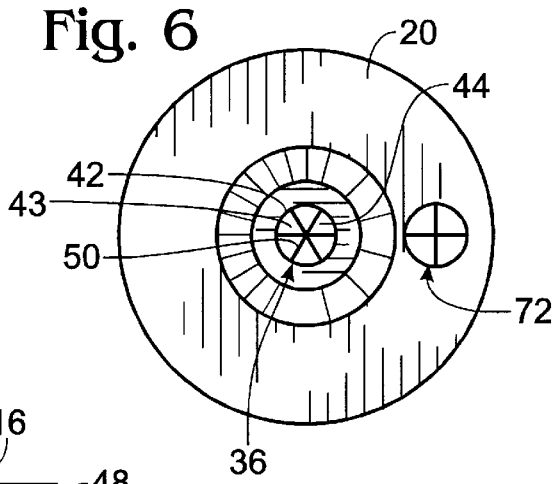
FIG. 6 is a bottom view of the drink valve of FIG. 1.

FIG. 6 shows a bottom view of valve 10, with flange 20, open region 36 and gate structure 42. Gate structure 42 can be seen to include six pie-piece-shaped members or segments, such as members 43 and 44. The members shown in FIG. 6 are together, with each pie-piece-shaped member touching adjacent members to close passageway 14.

The members, such as members 43 and 44, together define a section extending over the end of passageway 14 adjacent second end 32 of straw structure 12. The section defined by the members extends across the passageway. A plurality of slits in the section, such as slit 50 shown in FIGS. 5 and 6, define the members. In the embodiment shown in FIGS. 5 and 6, gate structure 42 has a substantially circular cross section, and slits like slit 50 extend diametrically relative to that cross section to define the substantially pie-piece-shaped members. The embodiment shown in FIGS. 5 and 6 includes three diametrical slits, or viewed another way, six radial slits. The slits extend all the way across gate structure 42. Straw structure 12 also defines a longitudinal axis, and the slits in the gate structure, such as slit 50, extend radially and symmetrically from the longitudinal axis.

As shown in FIG. 5, gate structure 42 extends down from second end 32 of straw structure 12, and the portion that extends below shoulder 38 creates an edge 52. The slits which define the members, such as slit 50, also extend into edge 52, as shown in FIG. 5, to allow the members to spread apart.

Figure 10:
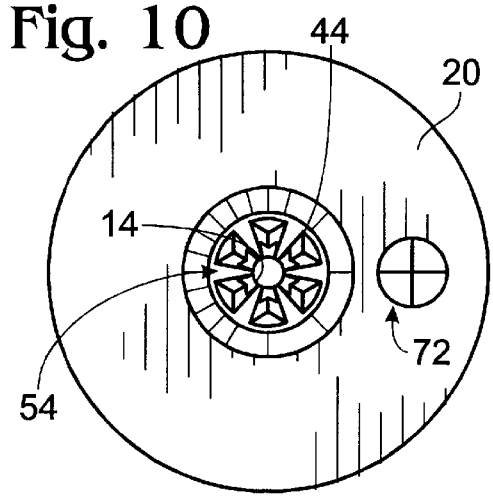
FIG. 10 is a bottom view of the drink valve of FIG. 9, with the valve open.
Figure 9:
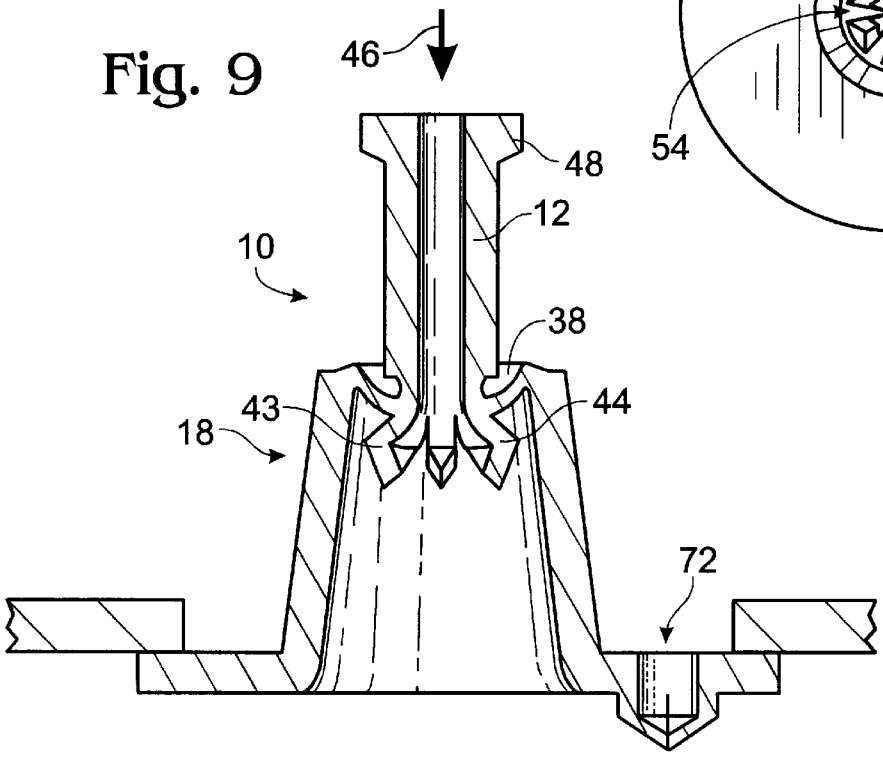
FIG. 9 is a cross-sectional view of the drink valve of FIG. 1, with the valve open.

FIGS. 9 and 10 show how those members spread apart to open the passageway. FIG. 9 is a cross sectional view of valve 10, similar to FIG. 5, except that straw structure 12 has been moved down in the direction of arrow 46, causing the members such as members 43 and 44 to spread apart. FIG. 10 shows a bottom view of valve 10 with the members, such as member 44, spread apart so that passageway 14 is open to fluid flow. Members such as member 44 may also be thought of as cusps, and the gate structure may be thought as acting like a multi-cuspid-like valve, where the cusps or members spread apart to open and then come together again to close.

Figure 11:
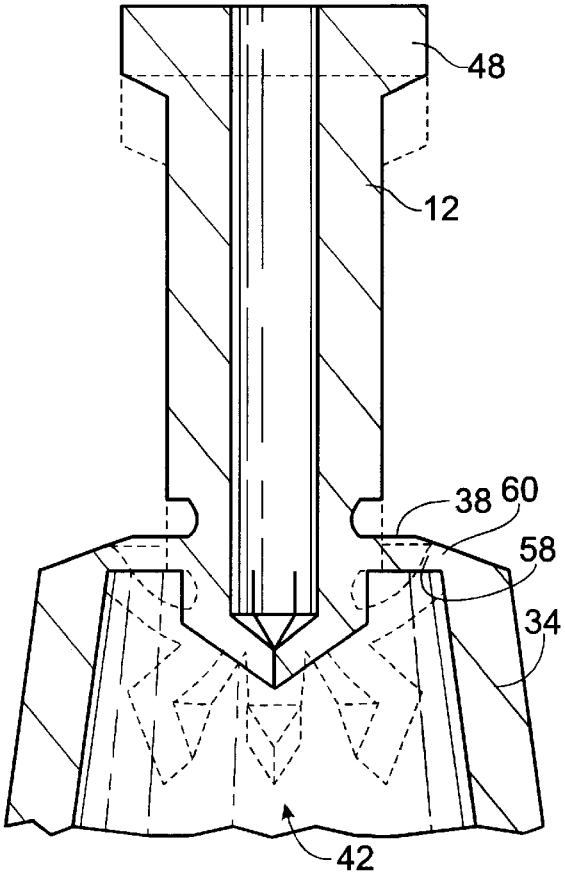
FIG. 11 is an enlarged view of a portion of the drink valve of FIG. 1, showing, n solid lines, the valve closed, and showing, in dashed lines, the valve open.

FIG. 11 is an enlarged sectional view of straw structure 12 and gate structure 42. The solid lines in FIG. 11 show gate structure 42 in a closed configuration. The dashed lines in FIG. 11 show gate structure 42 in an open configuration, with straw structure 12 having been moved down to open the gate structure. As straw structure 12 is moved down, shoulder 38 flexes and the members of the gate structure spread apart, as shown in dashed lines. That movement is facilitated by an annular groove 56 extending around second end 32 of straw structure 12. That movement is also facilitated by a thin region 60 where shoulder 38 joins perimeter wall 34.

Figure 12:
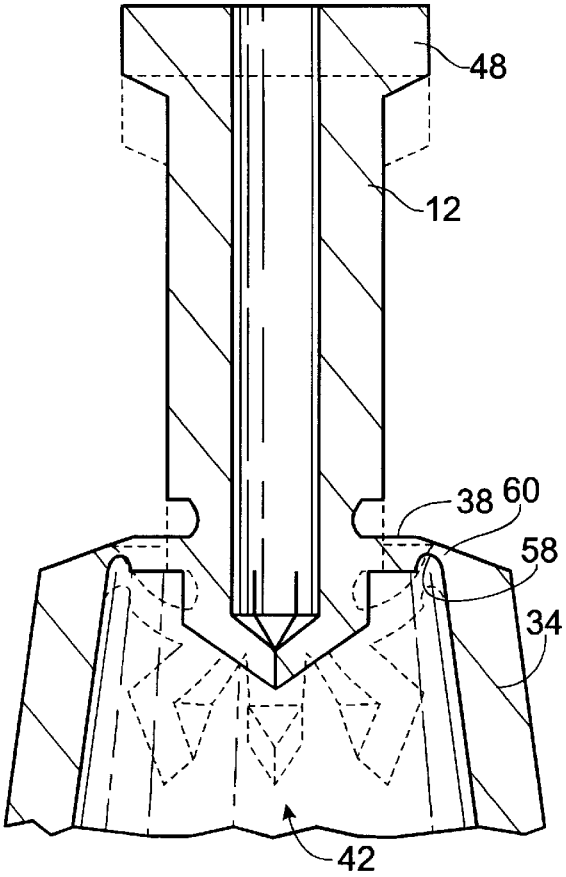
FIG. 12 shows a possible modification to the valve of FIG. 11.

FIG. 12 is similar to FIG. 11, except that it shows a modified shoulder 38. In FIG. 12, shoulder 38 includes an annular groove 58 in the shoulder, which makes region 60 even thinner. Region 60 helps shoulder 38 flex when straw structure 12 is moved. Annular grooves 56 and 58 and region 60 may be thought of as hinge points or live hinges in the straw structure and shoulder.

Spaces between the members, such as space 54 shown in FIG. 10, are created when the members spread apart. Those spaces allow fluid to flow into passageway 14 from the sides, as well as from below the passageway, thereby opening an area through which liquid may flow into the passageway. That open area is at least as great as the cross-sectional area of the passageway adjacent the gate structure. Therefore, the rate of liquid flow into the passageway when the gate structure is open is limited by the cross-sectional area of the passageway adjacent the gate structure and not by the gate structure itself. (Fluid flow through a passageway is believed to be proportional to $R^4$, where R is the radius of the passageway.) This is a significant, although not essential, advantage to the invention because it facilitates liquid flow.

Figure 13:
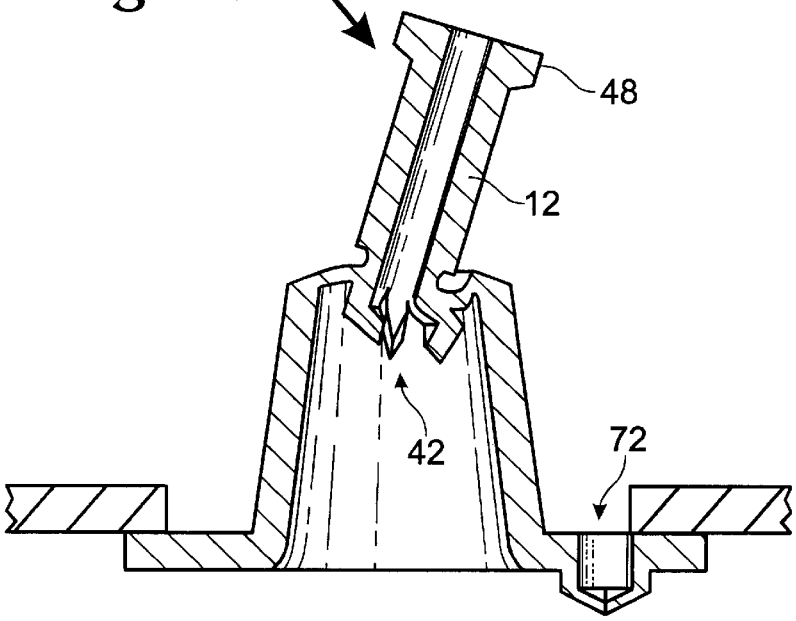
FIG. 13 illustrates another way to open the drink valve of FIG. 1.

FIGS. 9 through 12 show how the members of the gate structure open and close upon a downward movement of the straw structure. At least some of the members will also spread apart when the straw structure is moved in other ways, such as by tilting. The valves described by FIG. 5 through 12 are constructed so that substantially any movement of straw structure 12 opens gate structure 42. Different movements and degrees of movement of straw structure 12 cause gate structure 42 to open in varying degrees. FIG. 13 shows how the valve may open when straw structure 12 is tilted or moved sideways.

Figure 31:
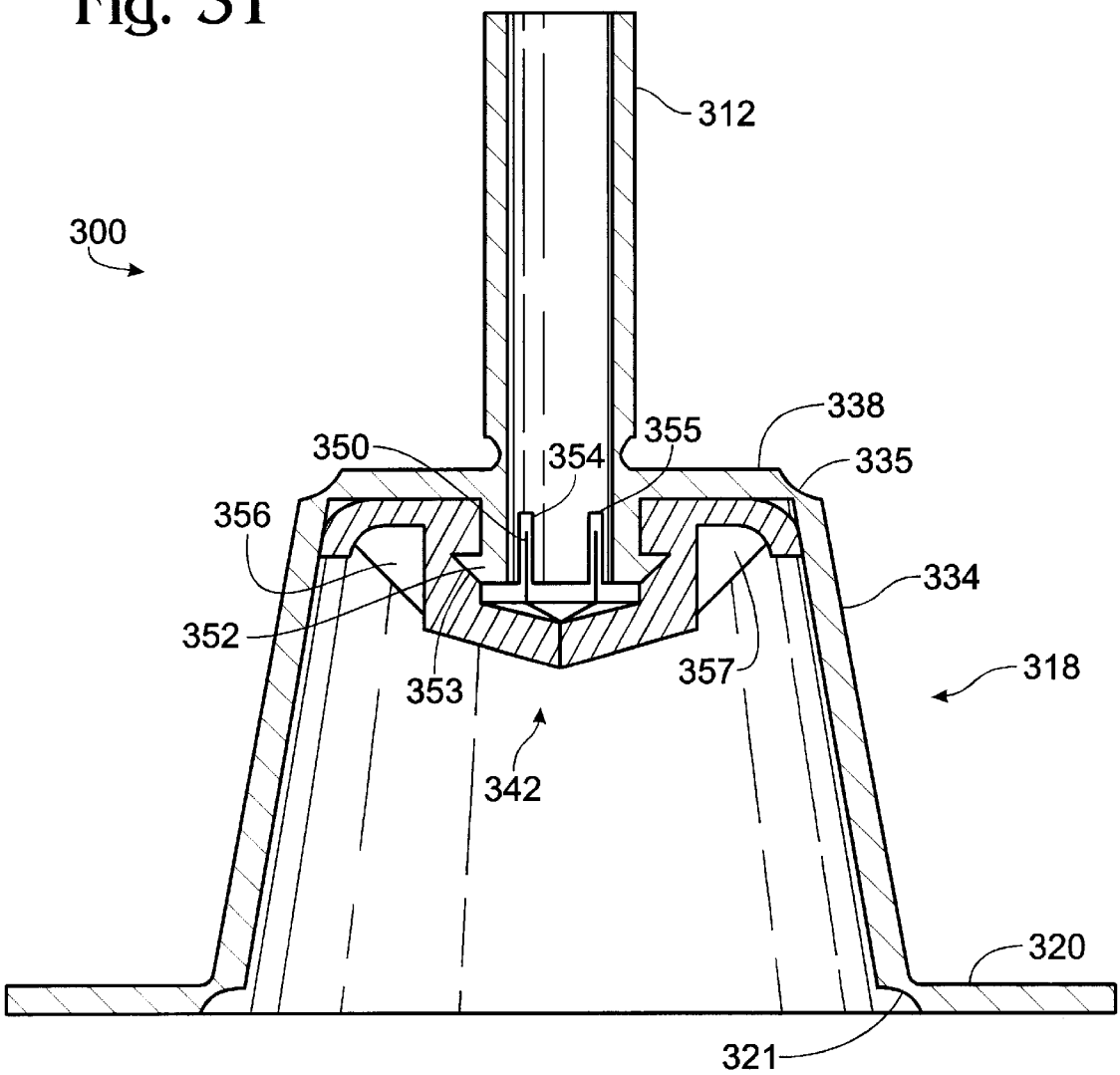
FIG. 31 shows a two-piece embodiment of the drink valve.

In use, the straw structure would be moved by a user, most often by the user gripping the straw structure with the teeth or lips and tilting the straw structure to the side or pushing it down. Straw structure 12 includes an enlargement 48, which may be thought of as a gripping structure, to help a user grip the straw structure. Of course, various types of gripping structure may be used, such as a plurality of bumps, steps or grooves in straw structure 12. Alternatively, straw structure 12 may be made without any gripping structure, as shown in FIG. 31.

Straw structure 12 and gate structure 42 may be a single piece made from an elastomeric material, such as silicon, Kraton, urethane, or other thermoplastic elastomer. The elastomeric material makes the straw structure flexible so that it may move. Shoulder section 38 of support 18 is also flexible, allowing straw structure 12 to move. In the embodiment shown in FIGS. 5 through 13, the entire valve 10 is made from a single piece of elastomeric material. The elastomeric material allows the pie-piece-shaped members, such as members 43 and 44, to spread apart and come together to form a tight seal.

The valve also closes automatically when the straw structure is released because the material from which the valve is made automatically returns to its original position. Elastomers have a high degree of what may be thought of as shape memory. In other words, elastomeric structures that have specified shapes may quickly move or return to those shapes after being flexed. Because of the valve's flexibility and shape memory, the straw structure may be moved to open the valve, and the straw structure will return to its original position to close the valve when the straw structure is released.

Figure 14:
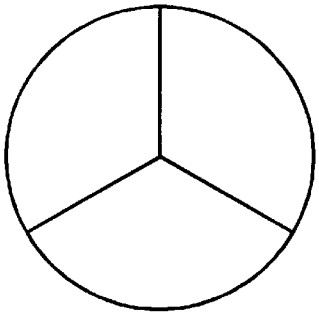
FIGS. 14 through 22 show various gate structures used in the drink valve.
Figure 15:
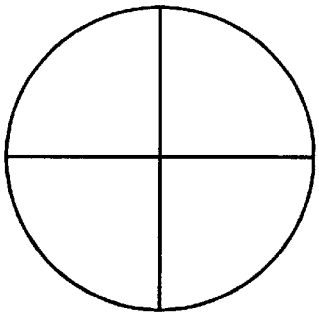
Figure 16:
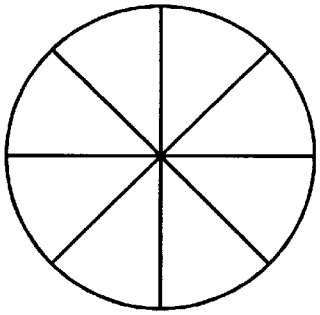

FIGS. 5 through 13 show embodiments of the valve with a gate structure 42 having pie-piece-shaped members. Numerous other gate structures are possible. FIGS. 14 through 22 show several other gate structures with various slits defining the members. FIG. 14 shows a gate structure with three pie-piece-shaped members instead of six, FIG. 15 shows four pie-piece-shaped members, and FIG. 16 shows eight members. The pie-piece-shaped members in FIGS. 14 through 16 spread apart to open the passageway, similar to what is shown in FIGS. 9 through 13 and as explained above.

Figure 17:
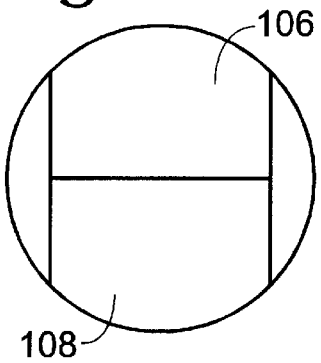
Figure 18:
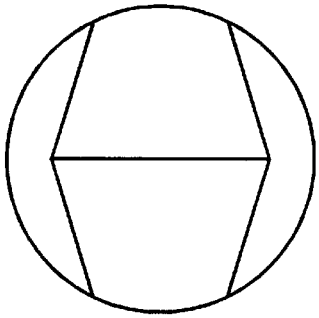
Figure 19:
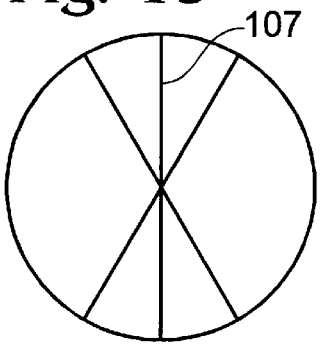

FIG. 17 shows slits in an "H" configuration, and FIG. 18 shows slits arranged in a modified "H" shape. The members defined by these slits, such as members 106 and 108 in FIG. 17, also spread apart to open the valve. The members may spread apart as shown in FIGS. 9 through 13, except that the members themselves will have different shapes, or only one or two members may move outwardly, depending on how the straw section is moved. FIG. 19 shows yet another slit configuration. The slit configurations shown in FIGS. 17 through 19 are particularly useful if the valve is to be opened by a tilting movement of the straw structure. Such a movement would cause at least one of the members, such as member 106 or 108 in FIG. 17, to move outwardly to open the valve. The slit configurations shown in FIGS. 17 through 19 are designed for a straw structure to be tilted in a direction that may be thought of as toward the top or bottom of the gate structures, as the gate structures are shown in these figures. In other words, the straw structure should be tilted substantially along line 107 in FIG. 19.

Figure 20:
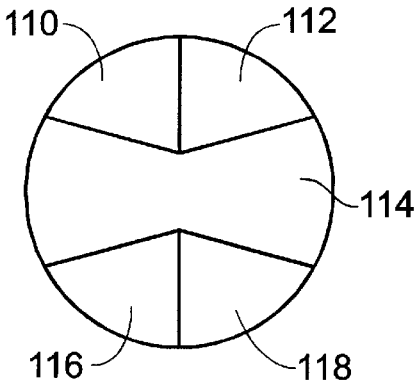

FIG. 20 shows a gate structure with two pie-piece-shaped members 110 and 112 on one side of a bow-tie-shaped member 114, and two more pie-piece-shaped members 116 and 118 on the other side of the bow-tie-shaped member. The bow-tie-shaped member spans the bottom of straw structure 12 and is connected to or integral with the straw structure so that it does not open or close when the straw structure is moved. When straw structure 12 is moved, the pie-piece-shaped members flare outwardly, away from the bow-tie-shaped member, opening the valve. When the straw structure is released, the pie-piece-shaped members return to their normal positions in contact with the bow-tie-shaped member to close the valve. This configuration has the advantage that the moving members seal against a non-moving portion of the gate structure, which may result in a more reliable seal. This gate configuration also is especially applicable when the valve is intended to be opened by a tilting or sideways movement of the straw structure, which would be a top to bottom movement if the gate structure is positioned as shown in FIG. 20.

Figure 21:
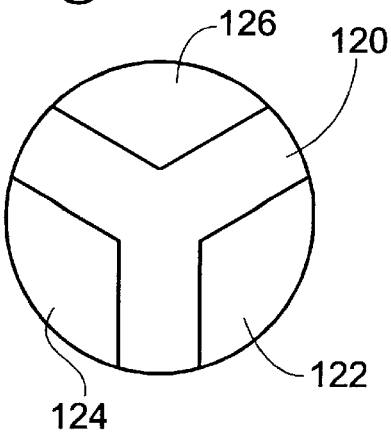
Figure 22:
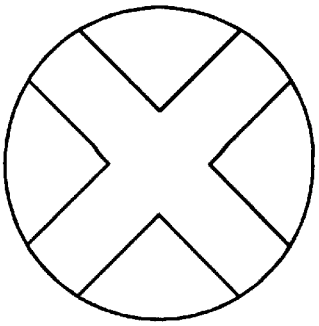

Another gate structure configuration is shown in FIG. 21. That structure includes a non-moveable "Y" shaped portion 120, and three moveable pie-piece-shaped members 122, 124 and 126. When the straw structure is moved, members 122, 124 and 126 spread apart to open the valve. Portion 120 does not move outwardly because it is connected to or integral with the straw structure. When the straw structure is released, members 122, 124 and 126 return to their normal closed position in contact with portion 120. The gate structure shown in FIG. 22 is similar to and works like the gate structure shown in FIG. 21, except FIG. 22 shows four moveable pie-piece-shaped members and a non-moveable portion shaped in a cross. These configurations also have the advantage that the moving members seal against a non-moving portion of the gate structure.

Figure 23:
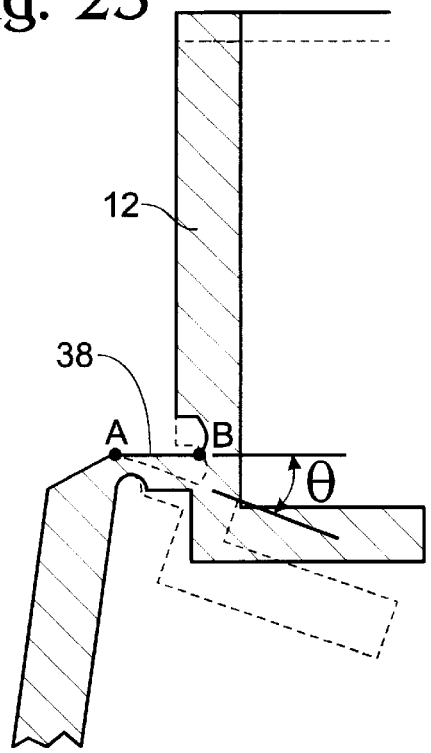
FIG. 23 shows geometry related to the drink valve of FIG. 1.

FIG. 23 shows how moving straw structure 12 causes the gate structure to open. FIG. 23 shows only a portion of valve 10 for simplicity. The solid lines in FIG. 23 show the gate structure or plug in a closed configuration, and the dashed lines show the gate structure or plug open. As straw structure 12 is moved, shoulder 38 moves through a distance represented by the angle θ. A motion of shoulder 38 may be thought of as a rotation-like motion around the point identified at "A," which acts as a fulcrum. The shorter the length of the shoulder from point A to point B in FIG. 23, the greater the magnification of movement of point C. That is because the length A to C is longer than the length A to B, but both move through the same angle. Thus, a small movement of the straw structure opens the valve.

Figure 24:
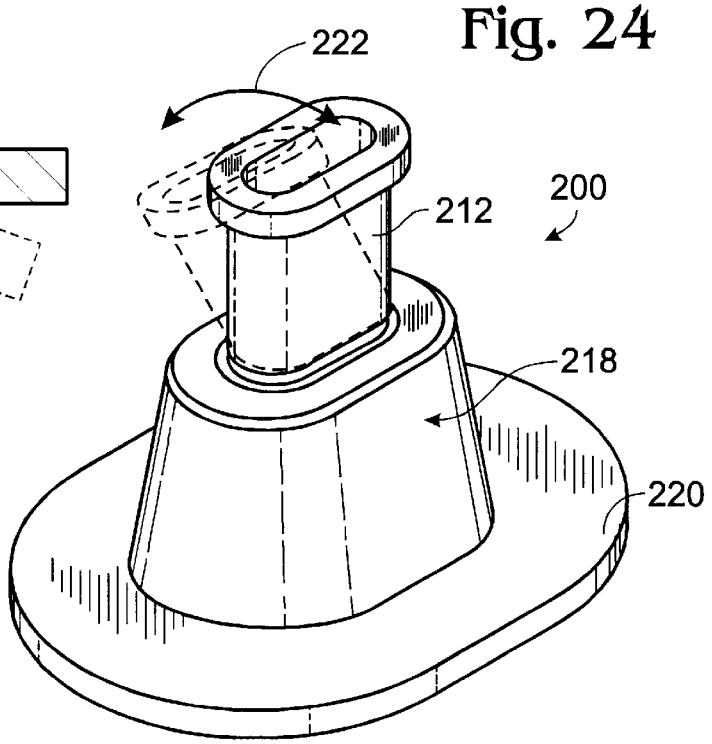
FIGS. 24 through 26 show another embodiment of the drink valve.
Figure 25:
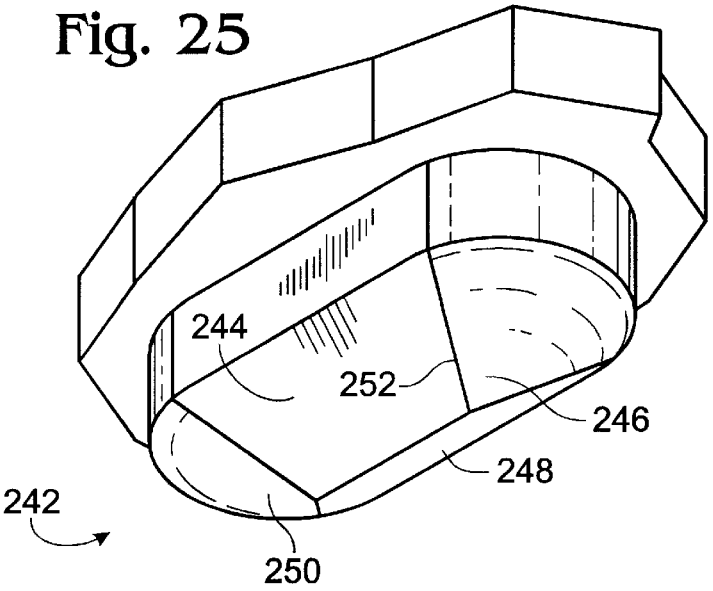
Figure 26:
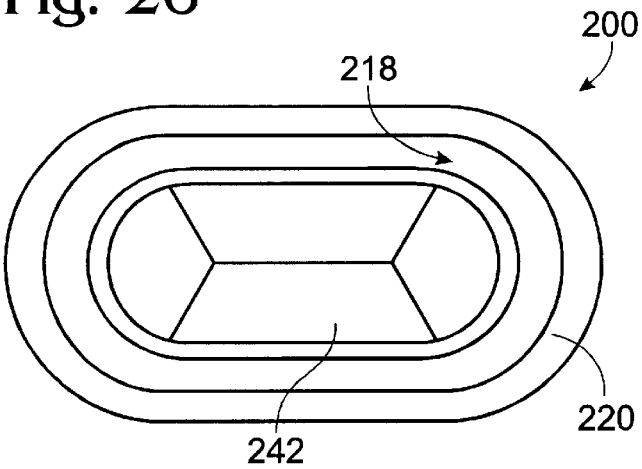

FIGS. 24, 25 and 26 show an embodiment of the valve specifically designed for a tilting or sideways movement of the straw structure. FIG. 24 shows a valve 200 with an obround-shaped straw structure 212, an obround support 218, and a flange 220. Straw structure 212 is designed to be tilted in the direction of arrow 222, as shown by the dotted lines in FIG. 24. Valve 200 is designed similar to the embodiments discussed previously. Straw structure 212 has a bottom end that terminates in a gate structure or plug 242. Gate structure 242 is shown in FIG. 25 separate from other structure and enlarged. The gate structure includes moveable members 244, 246, 248 and 250. Those members are separated by slits, such as slit 252. The members spread apart to open the valve, and close the valve when they are together, as with the embodiments discussed above. FIG. 26 shows a bottom view of valve 200, showing flange 220, the interior of support 218, and the interior of gate structure 242. This embodiment has the advantage that only a single one of members 244 or 248 needs to move away from the other members to open the valve because the obround shape allows for members 244 and 248 to be bigger than they otherwise would be. Because those members are sufficiently large, a substantial opening is created when either one of members 244 or 248 move. This configuration is particularly useful in a valve designed to be opened upon tilting of the straw structure in the direction of arrow 222 in FIG. 24 because such tilting causes one of members 244 or 248 to move.

Figure 27:
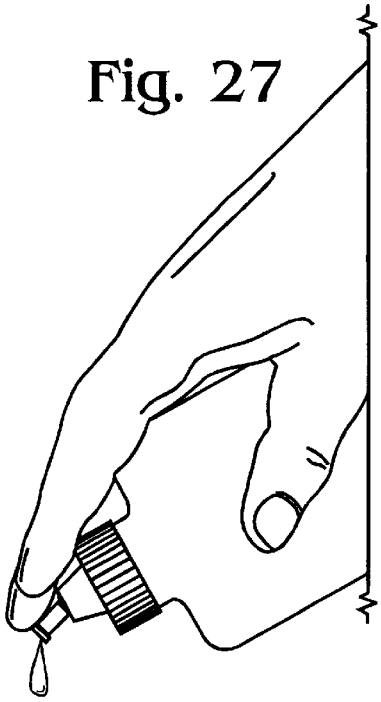
FIG. 27 illustrates a way to use the invented drink valve.

Valves that open upon the tilting of the straw structure are particularly useful for drink containers, as explained above, because a user may easily tilt the straw structure with the mouth. Such embodiments are also useful for pouring liquids such as sauces, syrups and oils from containers, as shown in FIG. 27.

Figure 28:
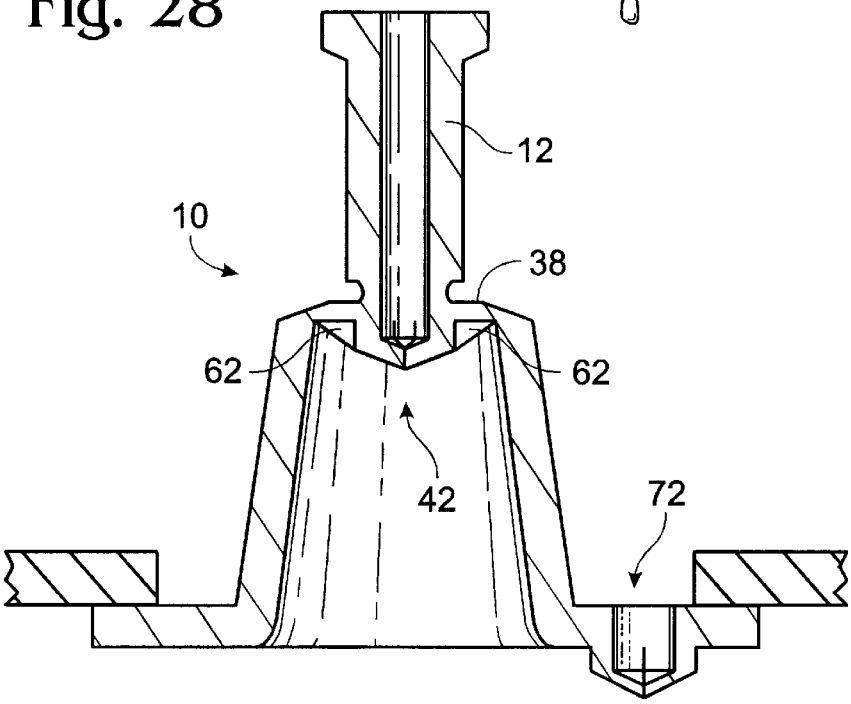
FIG. 28 is a cross-sectional view of another embodiment of a drink valve.

Another embodiment of the invented drink valve is shown in FIG. 28. Valve 10 is similar to the valve shown in FIG. 5, except that valve 10 in FIG. 28 includes gussets 62. The gussets support shoulder 38 to help assure that a movement of straw structure 12 causes gate structure 42 to open. The gussets also help the gate structure to close when the straw structure is released. Such gussets may be used on any of the embodiments discussed above, and any number of gussets may be used.

Figure 29:
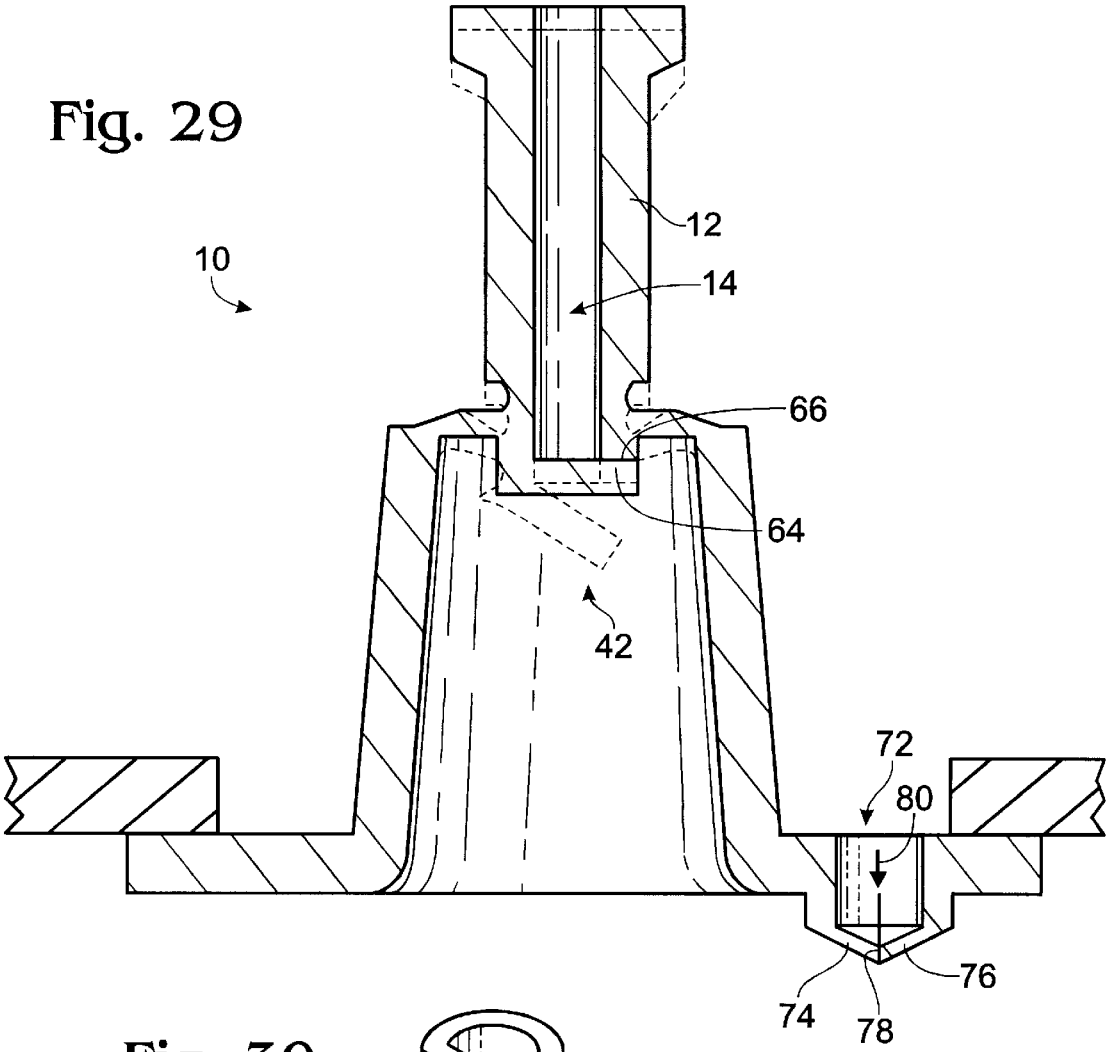
FIG. 29 is a cross-sectional view of another embodiment of the invention.

FIG. 29 shows yet another embodiment of drink valve 10. In this embodiment, gate structure 42 includes a flap 64 which extends perpendicularly across passageway 14. A slit 66 extends in a plane at an angle to the length of straw structure 12 to define the flap. In this embodiment, slit 66 extends substantially perpendicularly to the length of the straw structure. The slit extends through a substantial portion of the perimeter of straw structure 12. Flap 64 remains attached to straw structure 12 by a portion of the straw structure through which the slit does not pass. In the disclosed embodiment, straw structure 12 and flap 64 are integral, and made from a single piece of elastomeric material. Flap 64 opens and closes passageway 14 much like a flapper valve. The flap moves down and away from passageway 14 to open the passageway when straw structure 12 is moved downwardly, and flap 64 returns to its original, closed position when straw structure 12 is released. The dashed lines in FIG. 29 show flap 64 in an open position. Flap 64 may also open when straw structure 12 is tilted to one side. One or more gussets, such as gusset 62 in FIG. 28, may also be used in this embodiment of the invention.

Figure 30:
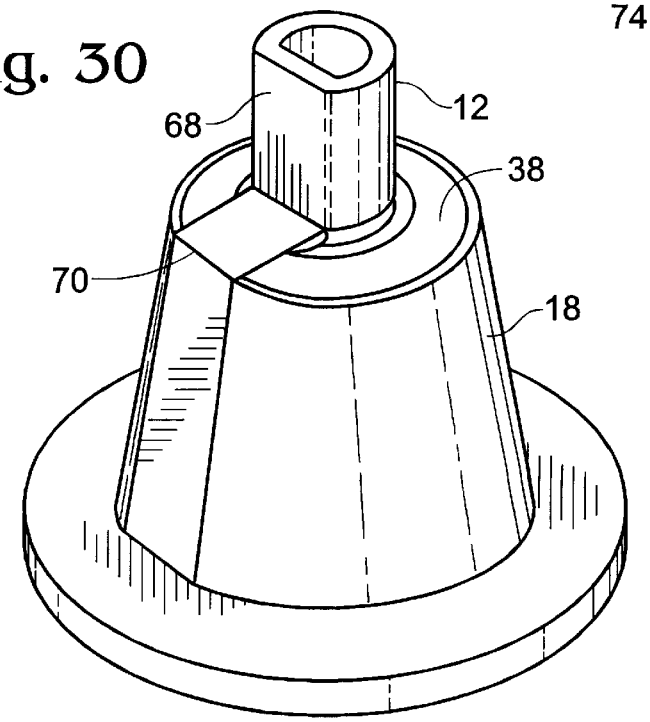
FIG. 30 is a perspective view of another embodiment of the invented drink valve.

FIG. 30 shows a perspective view of another embodiment of a drink valve. The drink valve in FIG. 30 includes a flat section 68 on one side of straw structure 12. The flat section allows a user to press a finger against straw structure 12, thereby tilting the straw structure to open the valve. Flat section 68, by providing a surface against which a finger may push, indicates which direction straw structure 12 should be tilted for maximum opening. A support 18, which includes a shoulder 38, holds straw structure 12 in place. Support 18 includes a straight edge 70 as part of shoulder 38. The straight edge encourages the valve to flex along the edge to help open the valve when straw structure 12 is tilted.

The valves shown in FIGS. 1 through 30 may all include a vent 72, as shown in FIG. 29. Vent 72 allows air to enter into a drink container in the direction of arrow 80 when the pressure outside the drink container is greater than the pressure inside the drink container, but the vent does not allow liquid to exit the drink container. Thus, vent 72 functions as a one-way valve so that air may enter the container to replace liquid that has been removed from the container. In FIG. 29, vent 72 includes lips 74 and 76 separated by a slit 78. In FIGS. 6 and 10, the vent includes two slits defining four members. Of course, different slit configurations, and even different vents may be used.

The invented drink valve may also be made from two pieces to allow portions of the valve to be made from materials such as low density polyethylene. Making a portion of the valve from low density polyethylene may be desirable from a manufacturing or cost point of view. A two-piece valve is shown at 300 in FIG. 31.

Valve 300 includes a straw structure 312, a support 318 with a shoulder 338, and a flange 320, all comprising a single piece made from a material such as polyethylene. Shoulder 338 is joined to a perimeter wall 334 by a live hinge 335. The live hinge is simply a thin portion of material between the shoulder and wall. Wall 334, in turn, joins with flange 320 by live hinge 321. The live hinges help promote flexibility in the valve.

Straw structure 312 includes a bottom edge 352 and an annular rib or barb 353 positioned around the outer surface of the bottom edge. A separate gate structure 342 is positioned around the bottom edge of the straw structure and over the annular barb. The gate structure is held in place by the barb and also by either a friction fit, a bonding agent, or by some other means. The gate structure extends over bottom edge 352 and against the bottom of shoulder 338, as shown. The gate structure includes several members or segments separated by slits, as discussed above. The gate structure is made from a thermoplastic elastomer so that the members create a seal when they contact each other.

The embodiment shown in FIG. 31 operates similar to the embodiments discussed above. Movement of the straw structure causes the members of the gate structure to spread apart. The bottom edge of the straw structure includes six slots around the perimeter, such as slots 354 and 355. These slots allow the bottom edge of the straw structure to spread apart slightly when the straw structure is moved, thereby facilitating the opening of the gate structure. Of course, different numbers of slots may be used. Slits in the gate structure, such as slit 350, may be seen through the slots. Gate structure 342 also includes gussets 356 and 357 which provide resilience for the straw portion to return to its upright position. More than two gussets may be used.

All of the gate structures described above, and equivalents, may be thought of as gate means for opening and closing a passageway to regulate the flow of liquid into the passageway.

Figure 32:
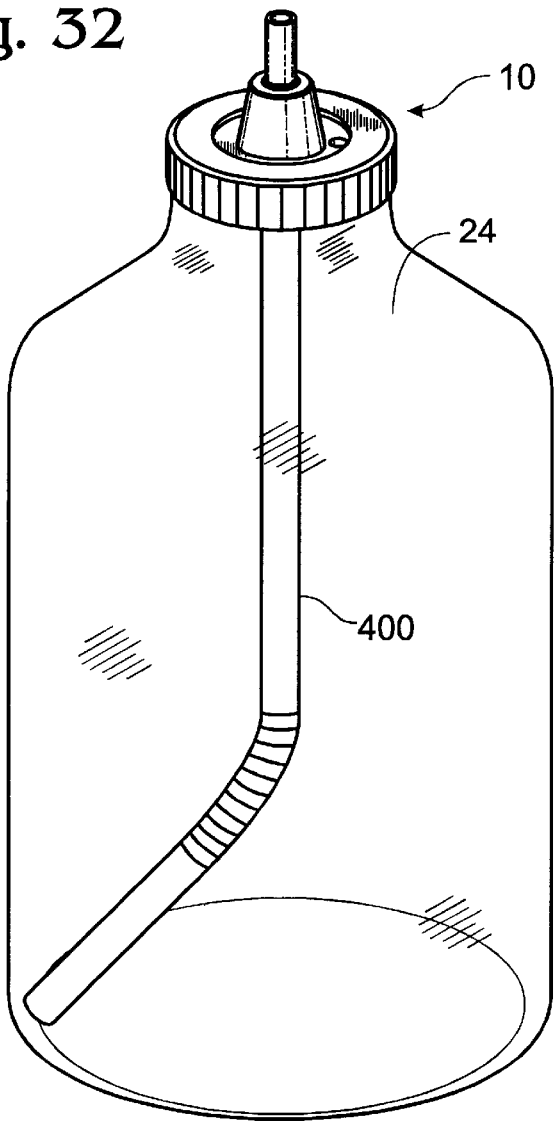
FIGS. 32 and 33 show an embodiment of the drink valve on a container with a straw extending into the container.
Figure 33:
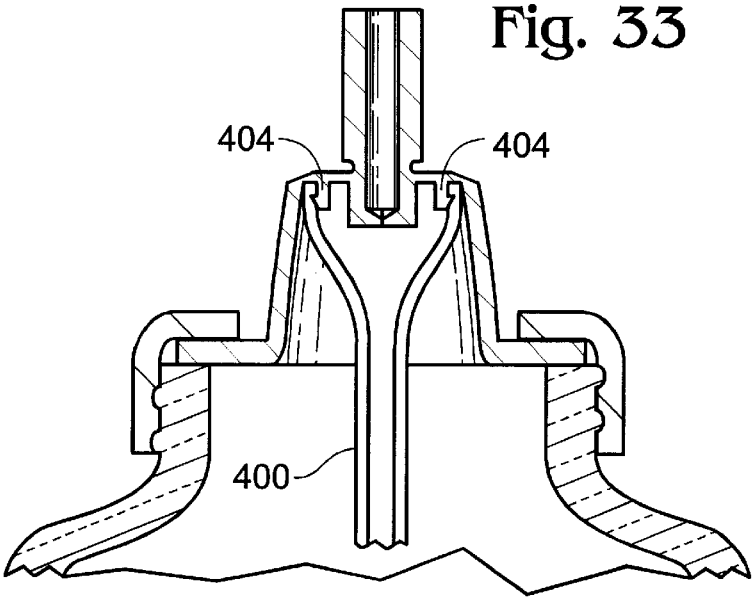

When one of the valves discussed above is mounted on a drink container, without any further structure, a user would have to tilt the drink container up while moving the straw structure to open the valve so that gravity would cause the liquid to flow through the valve. Having to tilt the drink container up may be avoided by using the valve with a straw that extends into the container, as shown in FIGS. 32 and 33.

In those figures, valve 10 is mounted on a bottle 24. A straw 400 extends into the bottle. The upper end of straw 400 is attached to valve 10 by snapping into place in a friction fit behind an annular rib or barb 404. Alternatively or additionally, the straw may snap into a groove or be glued into place. In this manner, a user may draw liquid out of the container through straw 400 when valve 10 is open.

Industrial Applicability

The invented drink valve is applicable in the drink packaging and other liquid packaging industries, and is specifically applicable to drink containers such as aseptic drink boxes and plastic and glass bottles.

While the invention has been disclosed in its preferred form, the specific embodiments thereof as disclosed and illustrated herein are not to be considered in a limiting sense as numerous variations are possible. Applicants regard the subject matter of their invention to include all novel and non-obvious combinations and subcombinations of the various elements, features, functions and/or properties disclosed herein. No single feature, function, element or property of the disclosed embodiments is essential. The following claims define certain combinations and subcombinations which are regarded as novel and non-obvious. Other combinations and subcombinations of features, functions, elements and/or properties may be claimed through amendment of the present claims or through presentation of new claims in this or a related application. Such claims, whether they are broader, narrower or equal in scope to the original claims, are also regarded as included within the subject matter of applicants' invention.

We claim:

1. A drink valve comprising:

a moveable straw structure having two ends and a passageway extending between the two ends through which liquid may pass;

a gate structure adjacent one end of the straw structure and configured to open and to close the passageway to regulate the flow of liquid into the passageway the gate structure including an expanse extending across the passageway to block the passageway and at least one slit associated with the expanse;

an exit port at one end of the straw structure whereby liquid may exit the passageway;

where the gate structure and the straw structure are configured so that at least one of a tilting or downward movement of the straw structure causes the gate structure to open the passageway by the expanse spreading apart at the at least one slit.

2. The drink valve of claim 1 where the straw structure and the gate structure are a single piece made from an elastomeric material.

3. The drink valve of claim 1 where the gate structure acts as a multi-cuspid-like valve.

4. The drink valve of claim 1 where the expanse includes a plurality of slits, the slits defining a plurality of members, and where at least one of the tilting or downward movement of the straw structure causes the members to spread apart to open the passageway.

5. The drink valve of claim 4 where the straw structure adjacent the gate structure has a substantially circular cross-section, and where the plurality of slits extend radially relative to that cross-section to define substantially pie-piece-shaped members.

6. The drink valve of claim 4 where the straw structure defines a longitudinal axis, and the plurality of slits extend radially from the longitudinal axis.

7. The drink valve of claim 6 where the slits extend symmetrically.

8. The drink valve of claim 4 where the slits further define a non-moveable member against which at least one other member contacts when the passageway is closed.

9. The drink valve of claim 1 where the straw structure has a length, and where the slit extends substantially perpendicularly to the length of the straw structure.

10. The drink valve of claim 1 where the expanse acts like a flapper to open and close the passageway.

11. The drink valve of claim 1 further comprising a support joined to the straw structure to support the straw structure while allowing the straw structure to move.

12. The drink valve of claim 11 where the support and the straw structure are a single piece made of an elastomeric material.

13. The drink valve of claim 12 where the support includes a flange for attachment to a drink container.

14. The drink valve of claim 11 where the support includes a flange configured to mount the drink valve to a drink container, and further comprising a vent associated with the flange to vent the drink container.

15. The drink valve of claim 1 where the straw structure is configured to automatically return, after being moved, to a position in which the gate structure closes the passageway.

16. A drink valve comprising:

a moveable straw structure having two ends and a passageway extending between the two ends through which liquid may pass;

an inlet at one end of the straw structure through which liquid may enter the passageway:

an exit at the other end of the straw structure through which liquid may exit the passageway; and a gate structure adjacent the inlet and configured to open and to close the passageway to regulate the flow of liquid into the passageway;

where the passageway has a cross-sectional area adjacent the gate structure; and where the gate structure is associated with the straw structure so that movement of the straw structure causes the gate structure to open an area through which liquid may flow into the passageway, the area being at least as great as the cross-sectional area of the passageway adjacent the gate structure.

17. A drink valve comprising:

a straw structure having first and second ends;

an inlet at the first end of the straw structure;

an exit at the second end of the straw structure;

a passageway within the straw structure extending from the inlet to the exit;

a support joined to the straw structure to support the straw structure while allowing the straw structure to move;

a plug over the inlet closing the passageway; and a plurality of slits in the plug, the slits defining a plurality of members;

where the plurality of members are moveable to open the passageway and where at least one of a tilting or downward movement of the straw structure causes movement of the members; and where opening of the passageway by the movement of the members allows liquid to pass through the passageway to the exit.

18. The drink valve of claim 17 where the plug is integral with the straw structure.

19. The drink valve of claim 17 where the drink valve is a single piece made from an elastomeric material.

20. The drink valve of claim 17 where the plurality of slits extend radially to define substantially pie-piece-shaped members.

21. A drink valve comprising:

a straw structure having two ends and a length extending between the ends;

an inlet at one end of the straw structure;

an exit at the other end of the straw structure;

a passageway within the straw structure extending from the inlet to the exit; and gate means adjacent the inlet for opening and closing the passageway to regulate the flow of liquid into the passageway;

where the gate means is associated with the straw structure so that at least one of a tilting or downward movement of the straw structure causes the gate means to open the passageway.

22. A drink container with a drink valve comprising:

an enclosure defining a region for the storage of liquid;

a moveable straw structure having an inlet, an exit, a length extending beyond the inlet toward the exit, and a passageway extending along the length between the inlet and exit through which liquid may pass;

a support mounted to the enclosure and joined to the straw structure to support the straw structure while allowing the straw structure to move; and a gate structure adjacent the inlet and configured to open and to close the passageway to regulate the flow of liquid into the passageway, the gate structure including an elastomeric expanse extending across the inlet to block the inlet, and at least one slit associated with the expanse;

where the gate structure is associated with the straw structure so that movement of the length of the straw structure causes the gate structure to open the passageway.

23. The drink container with a drink valve of claim 22 further comprising a straw extending from adjacent the gate structure into the region for the storage of liquid.

24. The drink container with a drink valve of claim 22 where the drink container is an aseptic drink container.

25. The drink container with a drink valve of claim 22 where the support is joined to the length of the straw structure beyond the inlet.

* * * * *